US005215660A

United States Patent [19]

Mosher et al.

[11] Patent Number: 5,215,660

[45] Date of Patent: Jun. 1, 1993

[54] FILTER DRIER FOR REFRIGERATION SYSTEM

[75] Inventors: William M. Mosher, Lyons; Jim J. Melfi, Elbridge, both of N.Y.

[73] Assignee: Parker Hannifin Corporation, Cleveland, Ohio

[21] Appl. No.: 827,677

[22] Filed: Jan. 29, 1992

[51] Int. Cl.[5] ..... B01D 27/08

[52] U.S. Cl. ..... 210/283; 210/284; 210/288; 210/289; 210/317; 210/320; 210/350; 210/439; 210/484; 210/489; 210/DIG. 7

[58] Field of Search ..... 210/282, 283, 288, 289, 210/290, 317, 320, 350, 439, 484, 489, DIG. 6, DIG. 7; 411/533

[56] References Cited

U.S. PATENT DOCUMENTS 4,436,623 5/1984 Cullen et al. ..... 210/282
4,834,603 5/1989 Holton ..... 411/533
4,908,132 3/1990 Koval et al. ..... 210/446

*Primary Examiner*—Matthew O. Savage

*Attorney, Agent, or Firm*—Ralph E. Jocke

[57] ABSTRACT

A filter drier (10) for an air conditioning or refrigeration system, has a body (12) with an interior area (20). The unit has an inlet opening (24) and an outlet opening (30). The outlet opening is in connection with an outlet tube (34) that extends substantially the length of the interior of the body. Donut shaped housings (54, 56) holding particles of desiccant material, are sandwiched between a first baffle (36) and a second baffle (72). The housings have an upper filter pad (58) of rigid, coarse fiber material, and a filter bag (62) of fine, flexible fiber material. In each housing, the filter bag is attached to the filter pad about its outer periphery at a seam (66), and at a seam (68) which is adjacent an opening (60) in the pad, through which the outlet tube extends. The filter bags of the donut shaped housings are deformed upon assembly to insure contact with the inner wall of the housing and the exterior surface of the outlet tube. The filter drier has increased contaminant absorbing capability and modular construction for ease of assembly.

13 Claims, 5 Drawing Sheets

FILTER DRIER FOR REFRIGERATION SYSTEM

TECHNICAL FIELD

This invention relates to filter driers which remove contaminants from refrigerant used as a working fluid in refrigeration and air conditioning systems. Particularly, this invention relates to a filter drier that avoids clogging due to trapped contaminants, and which has a construction that provides flexibility and ease of assembly.

BACKGROUND ART

Filter driers are used in air conditioning and refrigeration systems to remove water and other impurities from the oils and refrigerant materials which are used as working fluids in such systems. Filter driers, which are also called receiver dehydrators, are generally of two types. One type includes a solid core desiccant material which serves as filtration media. Solid cores of desiccant are often made from molded alumina or other materials having similar filtering and absorption properties. An example of a filter drier that has a solid desiccant core is shown in U.S. Pat. No. 4,908,132 which is owned by the Assignee of the present invention.

Another type of filter drier used in refrigeration and air conditioning systems uses a desiccant material that is in particle form. Care must be exercised in the construction of such filter driers to insure that the desiccant is contained within the body of the unit. If particles of desiccant material flow out of the filter drier and enter other components of the system, damage may occur.

Prior art filter driers have used a number of approaches to contain the particles of desiccant material. Some prior art filter driers have held the particles of desiccant between a pair of perforated plates inside the body of the unit. Usually pads of fiberglass or other fiberous material are positioned between the desiccant particles and the plates to aid in containment. The use of fiberous pads helps to avoid extrusion of the desiccant particles through the perforations in the plates which would otherwise occur when the plates are pressed together to pack the desiccant particles in relatively tight relation. Such packing is desirable from a filtration standpoint with many types of desiccants.

Another approach to containing desiccant particles is disclosed in U.S. Pat. No. 4,436,623 which is owned by Multiform Desiccants, Inc. This patent has the desiccant particles encapsulated in a cartridge made of polyester fabric. An advantage of this construction is that it simplifies assembly of the filter drier. This construction enables the loose desiccant to be assembled into the cartridge at a remote location. Upon assembly of the filter drier, the cartridge is simply placed in the housing. This approach makes assembly much easier and reduces the chance that particles will work loose during assembly and will later flow out of the filter drier causing damage to the remainder of the system.

The filter drier construction shown in U.S. Pat. No. 4,436,623 has several serious shortcomings, however. A fundamental problem is that it tends to become clogged with contaminants. This occurs because the fine polyester fabric and compressed desiccant at the upstream end of the cartridge readily becomes saturated with dirt and water. Once the fabric and desiccant at the upstream end of the cartridge are saturated, further impurities tend to be held at the surface of the cartridge. These impurities cannot reach the underlying desiccant which is available to absorb them. As a result, refrigerant flow through the cartridge is restricted and the filter drier must be replaced.

The configuration of the desiccant cartridge shown in U.S. Pat. No. 4,436,623 is also susceptible to being blocked by amounts of contaminants that may be readily handled by other types of filter driers. As a result, use of this construction is not practical in most applications. Further, the cartridge configuration shown in this patent is relatively expensive. This is because a plastic pipe must be incorporated into the cartridge so an outlet tube may extend through the center of the filter drier. This adds cost, both in terms of material and assembly time.

There is also a need to vary the amount of desiccant used in filter driers. Different systems may use different desiccant materials which may necessitate a desiccant bed of greater or lesser thickness. Some systems may require more or less desiccant because of system cleanliness requirements, or a greater anticipated level of contamination. Different refrigerants may also necessitate the use of more or less desiccant material in the filter drier.

Applicant is aware of no filter drier construction in which varying amounts and types of desiccant material may be readily incorporated without the use of customized parts that are made for the particular filter drier design.

Thus, there exists the need for a filter drier that provides ease of assembly, superior contaminant holding capability and low cost modular construction.

DISCLOSURE OF INVENTION

It is an object of the present invention to provide a filter drier that has superior contaminant holding capability.

It is a further object of the present invention to provide a filter drier that has an extended service life.

It is a further object of the present invention to provide a filter drier that has a simplified construction that provides ease of assembly.

It is a further object of the present invention to provide a filter drier that has a modular construction.

It is a further object of the present invention to provide a filter drier that is economical to manufacture.

Further objects of the present invention will be made apparent in the following Best Modes for Carrying Out Invention and the appended claims.

The foregoing objects are accomplished in the preferred embodiment of the invention by a filter drier for use in an air conditioning, refrigeration or heat pump system. The filter drier has a fluid tight body having an interior area. The interior area of the body is bounded by a cylindrical inner wall. The filter drier has an inlet for admitting refrigerant to a first end of the interior area of the body, and an outlet for enabling refrigerant to exit from a second end of the body. The outlet is in communication with an outlet tube that extends through the center of the interior of the body to the second end, enabling the inlet and outlet to be positioned adjacent one another on the exterior of the body.

A first disc shaped baffle is positioned in the interior area of the body. The baffle is perforated to enable flow of refrigerant material therethrough. The first baffle also has a central opening through which the outlet tube extends. The first baffle and opening are sized to be moveable with respect to the tube and the inner wall of the body.

Disposed from the first baffle in a direction towards the first end of the interior of the body is a second baffle. The second baffle has a central area with an opening through which the outlet tube extends. A plurality of ribs extend from the central area of the second baffle to an exterior flange at the periphery of the baffle. The ribs bound a plurality of relatively large openings through the second baffle. The second baffle is fixed to the inner wall of the body about the peripheral flange.

The filter drier of the present invention includes a novel housing for particulate desiccant material. The housing is positioned in the flow path for the refrigerant through the filter drier between the first and second baffle plates.

The desiccant housing has a filter pad of coarse, rigid fabric material which is adjacent the second baffle when the housing is installed. The housing extends substantially across the interior area of the housing to contact the interior wall. The pad has a first opening through which the outlet tube extends.

The housing for the desiccant material also includes a filter bag which is made from relatively fine, flexible fabric. The filter bag has a flexible outer sidewall. The filter bag is attached to the outer periphery of the filter pad along a first seam. The filter bag is also attached to the filter pad at a second seam which extends about the opening for the outlet tube. The area between the seams and the filter pad is filled with desiccant material, which in the preferred embodiment, is molecular sieve. The housing thus has a "donut" shape.

The housing or donut is positioned inside the housing with the side opposite of the filter pad supported on the first baffle. The first baffle is held in position inside the filter drier by a retainer which is mounted on the exterior of the outlet tube.

An advantage of the invention is that the housing has an end cap which enables access to the interior of the unit prior to assembly. During assembly, the second baffle is first fixed in place with respect to the cylindrical inner wall. Thereafter, the housing or donut holding the desiccant material is slid into place with its opening over the outlet tube and with the filter pad abutting the second baffle. If additional desiccant is required, multiple housings or donuts may be installed in stacked relation The first baffle may then be slid into position over the outlet tube so that it abuts the wall of the adjacent donut. The retainer is then positioned over the outlet tube to hold the entire assembly with the donut shaped housings sandwiched between the baffles.

When the retainer is installed, it is pressed into position against the first baffle. This serves to compress the baffle and the desiccant in the filter bags. As pressure is applied to the filter bags, the sidewalls thereof deform so that the bags enter into abutting relation with both the inner wall of the housing and the exterior of the outlet tube. This insures that no refrigerant can flow through the unit without passing through the desiccant material.

Once the baffle and housing are in position in the interior of the filter drier, the cap is fixed in position by brazing or other attaching process. This closes the housing and completes the assembly.

The desiccant housing of the present invention has the advantage that the coarse material of the pad does not hold contaminants on its surface as is the case with the prior art housing. Instead, it catches only large particles and enables fine contaminants to pass through. It also disperses contaminants into the desiccant material. The filter bag and the compressed particles of desiccant in the area of the donut abutting the first baffle, provide fine filtration. As a result, the desiccant can absorb greater amounts of contaminants before becoming clogged. This provides a longer service life.

BEST MODES FOR CARRYING OUT INVENTION

Figure 1:
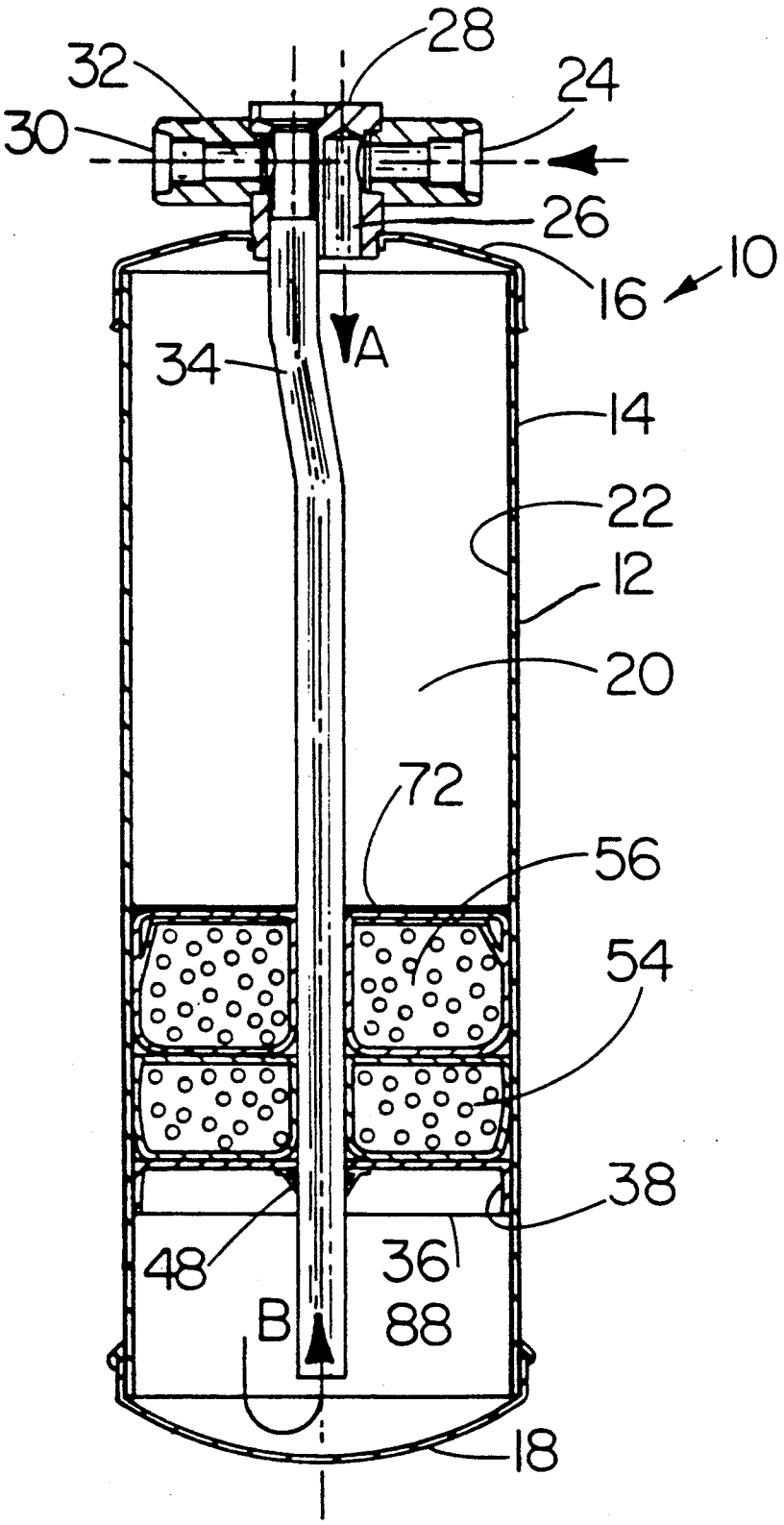
FIG. 1 is a cross sectional view of the filter drier of the preferred embodiment of the present invention.

Referring now to the drawings and particularly FIG. 1, there is shown therein a preferred embodiment of the present invention generally indicated 10. The device has a body 12. Body 12 includes a central cylindrical portion 14, a first end cap 16 shown at the top in FIG. 1, and a second end cap 18. When the filter drier is in the assembled condition shown in FIG. 1, the end caps are fixed to the central portion of the body by welding or brazing. The body encloses an interior area 20. Interior area 20 is bounded by an inner wall 22 of the body.

Filter drier 10 includes an inlet opening 24 into which refrigerant material flows. Inlet opening 24 extends through an inlet passage 26 in a fitting 28, Which is mounted on first end cap 16 in a conventional manner. Inlet passage 26 is open to the interior area 20 of the body. Fitting 28 also includes an outlet opening 30. The outlet opening is in communication with an outlet passage 32 through fitting 28. Outlet passage 32 is in fluid connection with a hollow outlet tube 34 which extends from the fitting to adjacent second end cap 18. Outlet tube 34 has an opening (not shown) in its lowermost portion as shown in FIG. 1.

Figure 4:
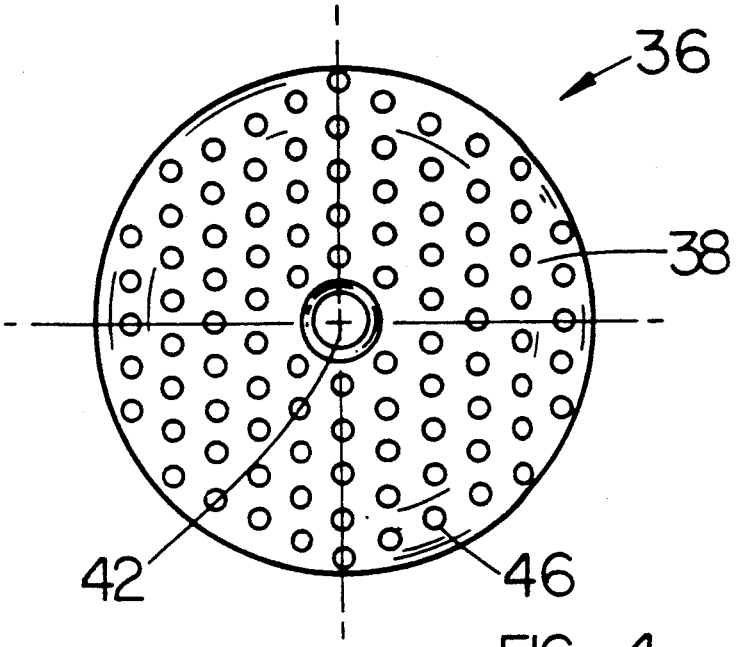
FIG. 4 is a plan view of the first baffle of the preferred embodiment.
Figure 5:
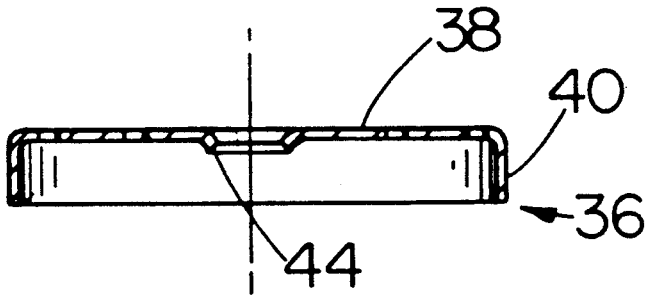
FIG. 5 is a side sectional view of the first baffle.

Mounted in the interior area of the filter drier is a first baffle 36. As shown in FIGS. 4 and 5, first baffle 36 includes a flat circular plate portion bounded by an outer flange portion 40. Outer flange portion 40 has a slightly smaller diameter than the diameter of the inner wall of the central portion of the body and is moveable relative thereto.

Plate portion 38 includes a centrally located access hole 42 which is surrounded by tapered lip 44. Plate portion 38 also includes a plurality of smaller fluid holes 46 the purpose of which is later explained.

Figure 8:
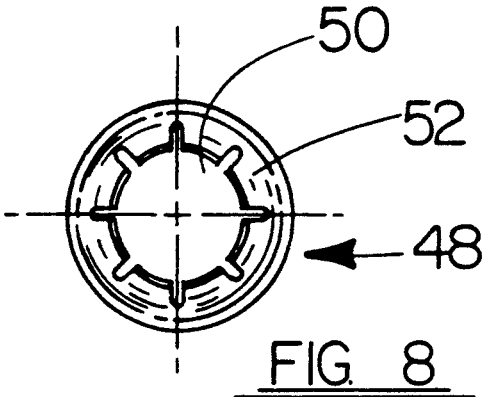
FIG. 8 is a plan view of the retainer used to hold and compress the first baffle and desiccant housing.
Figure 9:
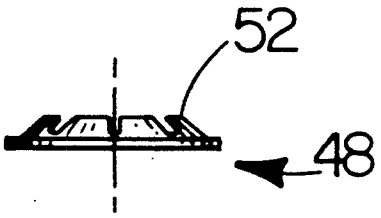
FIG. 9 is a side view of the retainer.

When assembled in filter drier 10, the underside of first baffle 36 is supported by a retaining clip 48. The retaining clip, shown is detail in FIGS. 8 and 9, has a central opening 50 which is slightly smaller than the outer diameter of outlet tube 34. Retaining clip 48 also has a plurality of spring-like fingers 52. The retaining clip construction enables retaining clip 48 to be pressed upward as shown in FIG. 1, onto outlet tube 34 when the fingers are directed at a downward angle. Once positioned on tube 34, the retaining clip is prevented from moving downward by the spring-like fingers 52 pressing against the outlet tube.

First baffle 36 is in supporting contact with a first desiccant housing or "donut" 54. A second desiccant housing 56 is in stacked relation with housing 54. In the preferred embodiment of the invention shown in FIG. 1, the first and second housings 54, 56 are identical in construction, but in other embodiments of the invention there may be more or less housings and the stacked housings or donuts may not be identical.

Figure 3:
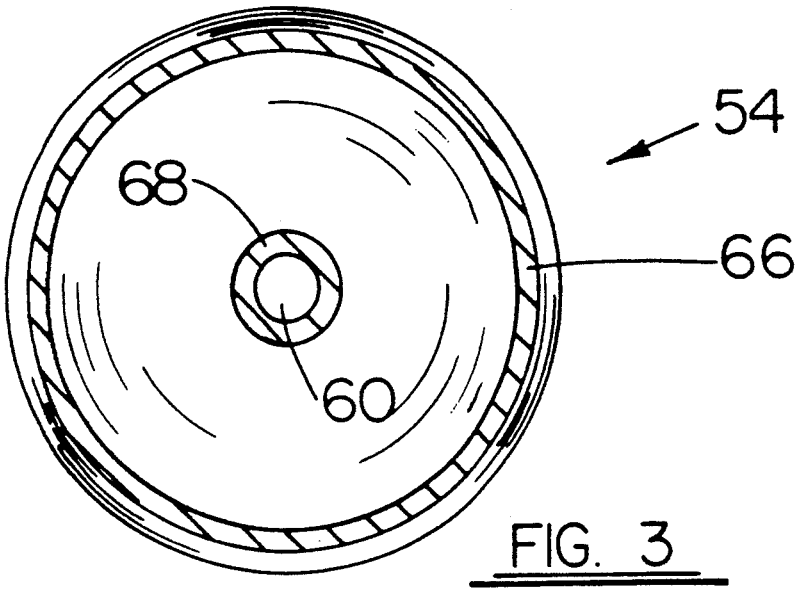
FIG. 3 is a top plan view of the desiccant housing.
Figure 2:
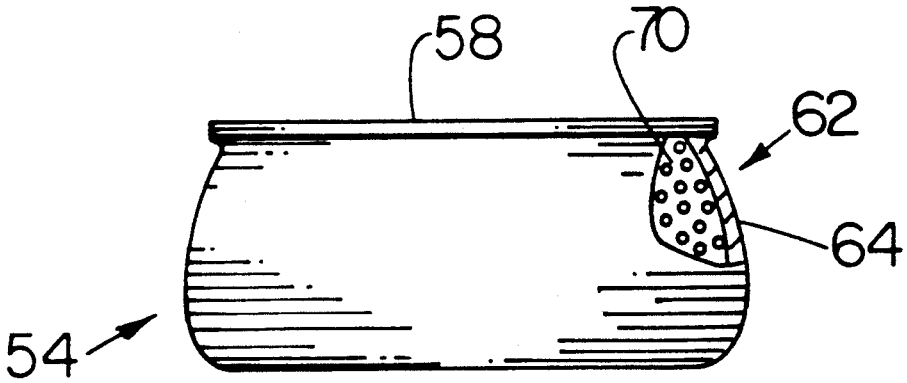
FIG. 2 is a partially sectioned side view of the desiccant housing of the preferred embodiment of the present invention.

The first housing 54 is shown in detail in FIGS. 2 and 3. The housing has a pad 58 which is made from relatively rigid, coarse fabric material. Pad 58 has an opening 60 therein. Opening 60 is slightly larger in diameter than the outer wall of outlet tube 34. Housing 54 also has a filter bag 62. Filter bag 62 is made from relatively fine, flexible fabric material and has a flexible wall 64. Wall 64 of filter bag 62 is attached to filter pad 58 along a first seam 66 adjacent the outer area of the pad. Wall 60 for the filter bag is also attached to filter pad 58 along a second seam 68 which extends adjacent opening 60. The seams 66 and 68 are continuous and hold the desiccant material, generally indicated 70, between the filter pad and the filter bag.

In the preferred form of the invention, the filter pad is made from polyester fabric having a density from 8 to 10 ozs. per yard with a fiber of 15 denier 3 in. polyester staple. The pad is 0.12 to 0.16 in. thick. The filter bag is formed from polyester fabric having a weight from 8.5 to 10.5 ozs. per yard with a fiber of 3 denier 4 in. polyester staple. The wall of the filter bag is 0.14 to 0.18 in. thick. In the preferred embodiment, the seams are formed by electro-stitching, but in other embodiments other processes or attaching means may be used.

The desiccant used in the preferred embodiment is a molecular sieve material suitable for the refrigerant used in the system. In the preferred form of the invention which is used with R-12 refrigerant, the desiccant may be one of the types designated 4×8 - 4AXH5; 8×12 - XH9; 4×8 - XH7 or 8×12 -XH7 which are commercially available from the United Oil Products Company. Of course, in other embodiments, other desiccant materials may be used depending on the refrigerant material. For example, if the refrigerant is R-134A, the molecular sieve may be 8×12 - XH9; 4×8 - XH7 or 8×12 - XH7.

Figure 6:
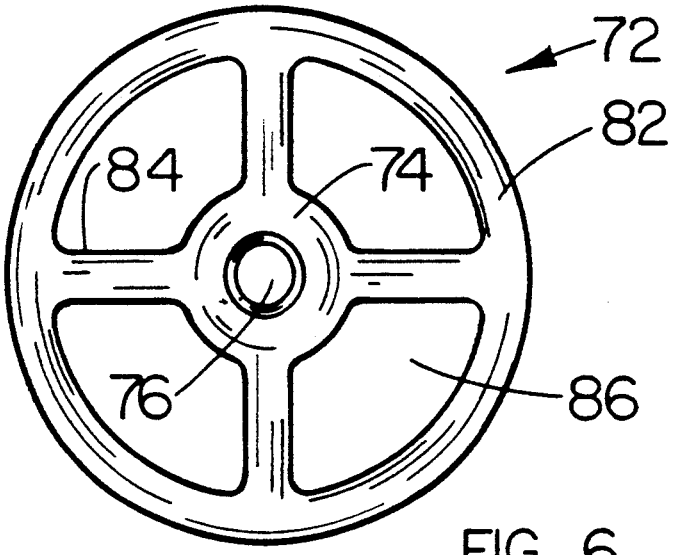
FIG. 6 is a plan view of the second baffle of the preferred embodiment.
Figure 7:
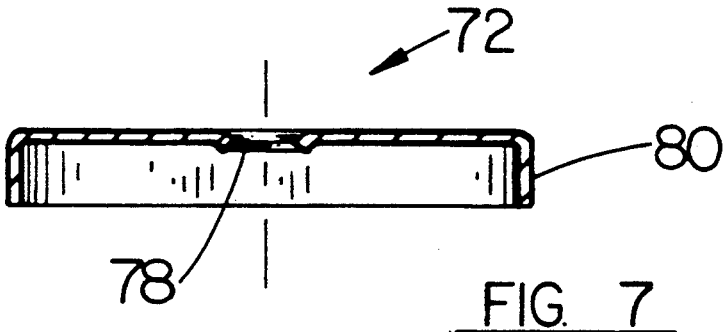
FIG. 7 is a side sectional view of the second baffle.

The filter drier 10 has in its interior, a second baffle 72. Second baffle 72 which is shown in greater detail in FIGS. 6 and 7, has a central area 74 with a central opening 76 therethrough. Opening 76 is bounded by a tapered lip 78.

Baffle 72 also includes an outer flange 80. An in-turned lip 82 extends circumferentially about the top of flange 80. Ribs 84, four of which are shown, extend from central area 74 to in-turned lip 82. Ribs 82 bound openings 86 through the upper surface of the baffle as shown in FIG. 1.

When baffle 72 is installed in the interior area of the filter drier, flange 80 is fixed to inner wall 22 by brazing or other attachment means. As shown in FIG. 1, the pad of the second housing 56 abuts baffle 52 when the filter drier is assembled.

The filter drier is assembled by first attaching fitting 28 to end cap 16. Baffle 72 is then fixed in place inside cylindrical portion 14. End cap 16 brazed to cylindrical portion 14 with outlet tube 34 extending through opening 76 in baffle 72.

Housing 56 is then installed with its pad 58 abutting baffle 72 and its central opening 60 surrounding the outer diameter of outlet tube 34. Housing 54 is then installed with its pad abutting the bottom of the filter bag of housing 56.

Baffle 36 is then placed in position with its plate portion 38 abutting and in supporting contact with the filter bag of housing 54. Baffle 36 is installed with the outlet tube extending through access hole 42 in the baffle.

Thereafter, retaining clip 48 is pushed upward as shown in FIG. 1, to compress housings 54 and 56 between baffles 36 and 72. As housings 54 and 56 are compressed, the walls 54 of the filter bags deform as the contained desiccant material is compressed. The bags of both housings are deformed so that they press against the inner wall of the housing 22 and outer surface of the outlet tube 34. This provides for the housings to completely occupy the flow path between the inlet and the outlet of the filter drier and insures that all refrigerant must pass through the desiccant material.

In the preferred embodiment, the filter pad of the housing is sized to be the same diameter as the interior diameter of the housing. As a result, the filter pad extends across the entire open area inside the housing, and in the case of housing 56, is compressed slightly at the edges so as to fit within second baffle 72.

Although the form of the invention shown in FIG. 1 includes two desiccant housings, other embodiments may have a single housing or multiple housings. Housings in other embodiments may be of various thicknesses as required for the refrigerant or the type of system in which the filter drier is to be used. An advantage of the present invention is that the same body construction may be used with varying amounts and types of desiccant material without having to make structural changes to any of the parts except the housings.

In operation of the filter drier, refrigerant is delivered to the inlet opening 24. Refrigerant passes through the inlet passage 26 in fitting 28, and enters the interior area 20 of the body as indicated by arrow A.

The refrigerant passes through the openings 86 in baffle 72. The refrigerant material then passes through the desiccant material in housing 56 and through its associated filter bag. Thereafter, the refrigerant passes through the filter pad, desiccant and filter bag of housing 54. As the refrigerant passes through the housings, impurities, including water or particulate matter are removed.

After filtering, the refrigerant passes through the fluid holes 46 in baffle 36 and enters an end area 88 of the body. From the end area 88, the refrigerant passes into outlet tube 34 and flows upward. The refrigerant passes from the outlet tube into outlet passage 32 in fitting 28. The refrigerant exhausts from the filter drier 10 through outlet opening 30.

The preferred embodiment of the filter drier of the present invention provides suitable filtration while avoiding pressure drop due to clogging by impurities. This is accomplished because the pads 58 of the housings provides coarse filtration (about 30 microns) while the filter bags 62 provide fine filtration (about 10 microns). As the refrigerant passes through the filter pad, large particulates are removed. In addition, the pad serves to disperse and direct the refrigerant, as well as smaller contaminants contained therein, into the desiccant below. As a result of the coarse nature of the filter pad as well as the large openings 86 in baffle 72, the upstream surface of the housing does not readily tend to saturate with impurities as in the case with housings known in the prior art.

The novel construction of the present invention not only provides for a flexible modular construction which simplifies assembly and reduces costs, but also extends service life. This is because the desiccant material at the upstream end of the housings does not tend to become saturated as readily, and more contaminants are absorbed before the pressure drop becomes so severe that the filter drier must be replaced.

Thus the new filter drier achieves the above stated objectives, eliminates difficulties encountered in the use of prior devices, solves problems and obtains the desirable results described herein.

In the foregoing description, certain terms have been used for brevity, clarity and understanding, however, no unnecessary limitations are to be implied therefrom because such terms are for descriptive purposes and are intended to be broadly construed. Moreover, the descriptions and illustrations given are by way of examples and invention is not limited to the exact details shown or described.

Having described the features, discoveries and principles of the invention, the manner in which it is constructed and operated, and the advantages and useful results obtained; the new and useful structures, devices, elements, arrangements, parts, combinations, systems, equipment, operations and relationships are set forth in the appended claims.

We claim:

1. A filter drier for refrigerant flowing in an air conditioning or similar system, comprising:

a fluid tight body having an interior area, said interior area bounded by an inner wall;

inlet means for introducing refrigerant into the interior area of said body;

outlet means for enabling flow of refrigerant out from the interior area of said body;

first housing means for holding particles of a desiccant material therein, said housing means positioned in a refrigerant flow path from said inlet means to said outlet means, said first housing means including a first filter pad of porous, coarse, rigid fabric material enabling water and small particulate impurities to pass therethrough while sufficiently nonporous to prevent said desiccant particles from passing therethrough, said first filter pad extending substantially across said interior area, said filter pad having first peripheral portions adjacent said inner wall, and said first filter pad positioned adjacent said inlet means in said flow path;

a first filter bag of porous, fine, flexible fabric material, the material of said first filter bag being configured to remove particulate impurities of a size smaller than that removed by said first filter pad, said first filter bag positioned adjacent said outlet means in said flow path, said first filter bag attached by attaching means to said first filter pad along a first seam adjacent said first peripheral portions, wherein said particles of desiccant material are held between said first filter pad and said first filter bag, said first filter bag including a first flexible outer wall, said wall in abutting contact with said inner wall of said body.

2. The filter drier according to claim 1 and further comprising first rigid baffle means adjacent said outlet means for supporting said first filter bag and enabling the passage of refrigerant therethrough.

3. The filter drier according to claim 2 and further comprising a second rigid baffle means adjacent said inlet means for supporting said filter pad and enabling passage of refrigerant therethrough.

4. The filter drier according to claim 3 wherein said inner wall of said body is cylindrical, and said interior area includes a first end in communication with said inlet means and a second end in communication with said outlet means;

and wherein said outlet means comprises a fluid conduit extending from said second end of said interior area, through said first end to an outlet, said fluid conduit disposed radially inward from said inner wall and having an outer surface, said fluid conduit extending through said first and second baffle means;

and wherein said first filter pad further includes a first opening therethrough, said fluid conduit passing through said first opening; and and said first filter bag further includes a second seam attaching said first filter bag to said first filter pad, said second seam adjacent and extending about said first opening, and wherein a first sidewall of said first filter bag is in abutting contact with said surface of said fluid conduit.

5. The filter drier according to claim 4, wherein said fluid conduit comprises a circular outlet tube centered in said interior are with respect to said inner wall.

6. The filter drier according to claim 5, wherein said second baffle means is fixed to the inner wall of said body.

7. The filter drier according to claim 6, wherein said first baffle means is movable relative of said inner wall of said body, and said filter drier further comprises compression means for compressing said first housing means between said first and second baffle means.

8. The filter drier according to claim 7, wherein said first baffle means is a first generally disk shaped baffle having a first access hole therethrough, said outlet tube passing through said first access hole; and said compression means includes a retainer mounted on said outlet tube adjacent said first access hole, whereby said retainer holds said first housing means for said desiccant in a compressed condition.

9. The filter drier according to claim 8, wherein said second baffle means is a generally plate shaped baffle having an outer flange, said outer flange rigidly attached to said inner wall.

10. The filter drier according to claim 9, wherein said second baffle includes a central area having a first opening therethrough, said outlet tube passing through said first opening, and said second baffle includes at least one rib extending outward from said central area to an inturned lip, said lip extending circumferentially inward from said flange, said ribs defining at least one opening through said second baffle means.

11. The filter drier according to claim 10, wherein said second baffle means includes 4 equally spaced ribs defining 4 openings therethrough.

12. The filter drier according to claim 11, and further comprising a second housing means for housing particles of desiccant material, said second housing means positioned in stacked relation of said first housing means, said second housing means positioned between said first filter bag and said first baffle;

said second housing means comprising a second filter pad of porous, coarse, rigid fabric material enabling water and small particulate impurities to pass therethrough while sufficiently nonporous to prevent said desiccant particles from passing therethrough, said second filter pad extending substantially across said interior area of said body and in abutting relation of said first filter bag of said first housing means, said second filter pad having second peripheral portions adjacent said inner wall of said body and a second opening therethrough, said outlet tube passing through said second opening;

a second filter bag of porous, fine, flexible fabric material, the material of said second filter bag being configured to remove particulate impurities of a size smaller than that removed by said second filter pad, said second filter bag attached by attaching means to said second filter pad along a third seam adjacent said second peripheral portions and along a fourth seam extending adjacent said second opening, wherein particles of desiccant material are held between said second filter pad and said second filter bag, said second filter bag having a second flexible outer sidewall in abutting contact with said inner wall of said body, and a second sidewall in abutting contact with said outer surface of said tube.

13. A filter drier for refrigerant flowing in an air conditioning or other heat transfer system, comprising:

a fluid tight body having an interior area, said interior area bounded by a cylindrical inner wall, said interior area including a first end in communication with an inlet means for admitting refrigerant to said interior area, and an outlet means for enabling flow of refrigerant out from said interior area;

and wherein said outlet means comprises a fluid conduit extending from said second end of said interior area, through said first end to an outlet, said fluid conduit disposed radially inward from said inner wall, said conduit having an outer surface;

first housing means for holding a desiccant material therein, said housing means positioned in a refrigerant flow path from said inlet means to said outlet means;

a first filter pad of coarse, rigid fabric material, said first filter pad extending substantially across said interior area, said first filter pad having first peripheral portions adjacent said inner wall, said first filter pad further including a first opening therethrough, said fluid conduit passing through said first opening, said first filter pad positioned adjacent said inlet means in said flow path;

a first filter bag of fine, flexible fabric material, said first filter bag positioned adjacent said outlet means in said flow path, said first filter bag attached by attaching means to said first filter pad along a first seam adjacent said first peripheral portions, and wherein said first filter bag further includes a second seam attaching said first filter bag to said first filter pad, said second seam extending about said first opening, wherein said desiccant material is held between said first filter pad and said first filter bag, said first filter bag including a first flexible inner wall in abutting contact with said inner wall of said body, and a first flexible sidewall in abutting contact with the outer surface of the fluid conduit;

a first rigid baffle means adjacent said outlet means for supporting said first filter bag and enabling the passage of refrigerant therethrough; and a second rigid baffle means adjacent the inlet means for supporting the filter pad and enabling the passage of refrigerant therethrough.

* * * * *